US007126878B1

(12) United States Patent
Erikson

(10) Patent No.: US 7,126,878 B1
(45) Date of Patent: Oct. 24, 2006

(54) PUSH-PULL TONPILZ TRANSDUCER

(75) Inventor: Kenneth R. Erikson, Henniker, NH (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 11/044,822

(22) Filed: Jan. 27, 2005

Related U.S. Application Data

(60) Provisional application No. 60/539,389, filed on Jan. 27, 2004.

(51) Int. Cl.
*H04R 17/00* (2006.01)

(52) U.S. Cl. ..... 367/158

(58) Field of Classification Search ..... 367/158
See application file for complete search history.

(56) References Cited

U.S. PATENT DOCUMENTS 4,735,096 A * 4/1988 Dorr ..... 310/325
4,752,918 A * 6/1988 Boucher et al. ..... 367/158

FOREIGN PATENT DOCUMENTS

GB 2349464 * 11/2000

* cited by examiner

*Primary Examiner*—Dan Pihulic
(74) *Attorney, Agent, or Firm*—Daniel J. Long

(57) ABSTRACT

A Tonpilz transducer which includes a first stack of piezoceramic elements with a first plurality of electrodes connected to form a first pair of external connections. There is also a second stack of piezoceramic elements with a second plurality of electrodes connected to form a second pair of external connections, and the first and second stacks of piezoceramic elements have opposed polarizations.

1 Claim, 4 Drawing Sheets

PUSH-PULL TONPILZ TRANSDUCER

CROSS REFERENCE TO RELATED APPLICATION

This application claims rights under 15 U.S.C. 119(e) from U.S. Application Ser. No. 60/539,389 filed Jan. 27, 2004, the contents of which are incorporated herein by reference.

STATEMENT OF GOVERNMENT INTEREST

The invention was made with United States Government support under Contract No. N00014-00-D-0104 awarded by the Department of the Navy. The United States Government has certain rights in this invention.

BACKGROUND OF THE INVENTION

1. Field of the Invention

The present invention relates to acoustics and more particularly to transducers.

2. Brief Description of Prior Developments

The Tonpilz transducer has been the dominant technology for high-power underwater sound generation for many years. FIG. 1 is a schematic drawing of a typical transducer 1. A head-mass 3, piezoceramic stack 5 and a tail-mass 8 are bolted together with a tie rod 9 and nut 11. The other end of tie rod 9 is threaded and inserted into a tapped hole in head-mass 3.

The piezoceramic stack 5 consists of several annular rings 7 through which tie rod 9 passes. In FIG. 1 eight rings are shown, although numeral 7 is only shown for the uppermost three.

One such ring 7 is depicted in FIG. 2, which shows the central aperture 13 through which the tie rod passes. Also shown in FIGS. 1 and 2 are top electrode 15, consisting of metalization applied to the top surface of ring 7 and bottom electrode 17 consisting of similar metallization applied to the bottom surface of ring 7.

These electrodes are often somewhat smaller than the top and bottom surfaces of the piezoceramic ring 7 to prevent arcing when a high voltage is applied between electrodes 15 and 17.

In FIGS. 1 and 2, in each ring 7, an arrow 18 is shown to symbolically represent the piezoelectric polarization of the ring. By convention, when a positive voltage is applied between electrodes 15 and 17, the piezoceramic expands in thickness. Conversely, when a negative voltage is applied, the piezoceramic thickness decreases. If the voltage is an alternating voltage waveform such as sine wave, the piezoceramic will vibrate at the frequency of the waveform.

Referring to FIG. 1, when several rings are stacked up, all the top electrodes 15 are electrically connected together 19 forming a common external connection 21. Similarly, all bottom electrodes 17 are connected 23 to form a common external connection 25. It will be understood that a filled circle denotes an electrical connection, whereas a line crossing has no electrical connection. An open circle denotes an external connection.

Referring to FIG. 3, Tonpilz transducer 1 is connected by 21 and 25 to electrical matching elements 27 which are interposed between a power amplifier 29. Matching elements 27 may consist of a transformer 30, a capacitor 31 or an inductor 33 or a combination thereof, selected in accordance with the electrical properties of the transducer 1 and power amplifier 29 by techniques well know to those practiced in the art. These matching elements are used to optimize electrical efficiency. Electrical energy moves between the piezoelectric stack 5 and the matching elements 27 every half cycle of the applied voltage waveform.

Depending on the power levels to be achieved with the transducer, these matching elements, in particular inductors 33, may be physically large and require heavy gage wire to support the current requirements of the transducer. Often the required inductance is obtained using a magnetic core in inductor 33, leading to further size and weight to avoid saturation of the magnetic material. Once again, these techniques are well known to those skilled in the art.

SUMMARY OF INVENTION

The present invention is a Tonpilz transducer which includes a first stack of piezoceramic elements with a first plurality of electrodes connected to form a first pair of external connections. There is also a second stack of piezoceramic elements with a second plurality of electrodes connected to form a second pair of external connections, and the first and second stacks of piezoceramic elements have opposed polarizations.

BRIEF DESCRIPTION OF THE DRAWINGS

The present invention is further described with reference to the accompanying drawings, wherein.

DETAILED DESCRIPTION OF THE PREFERRED EMBODIMENT

Figure 1:
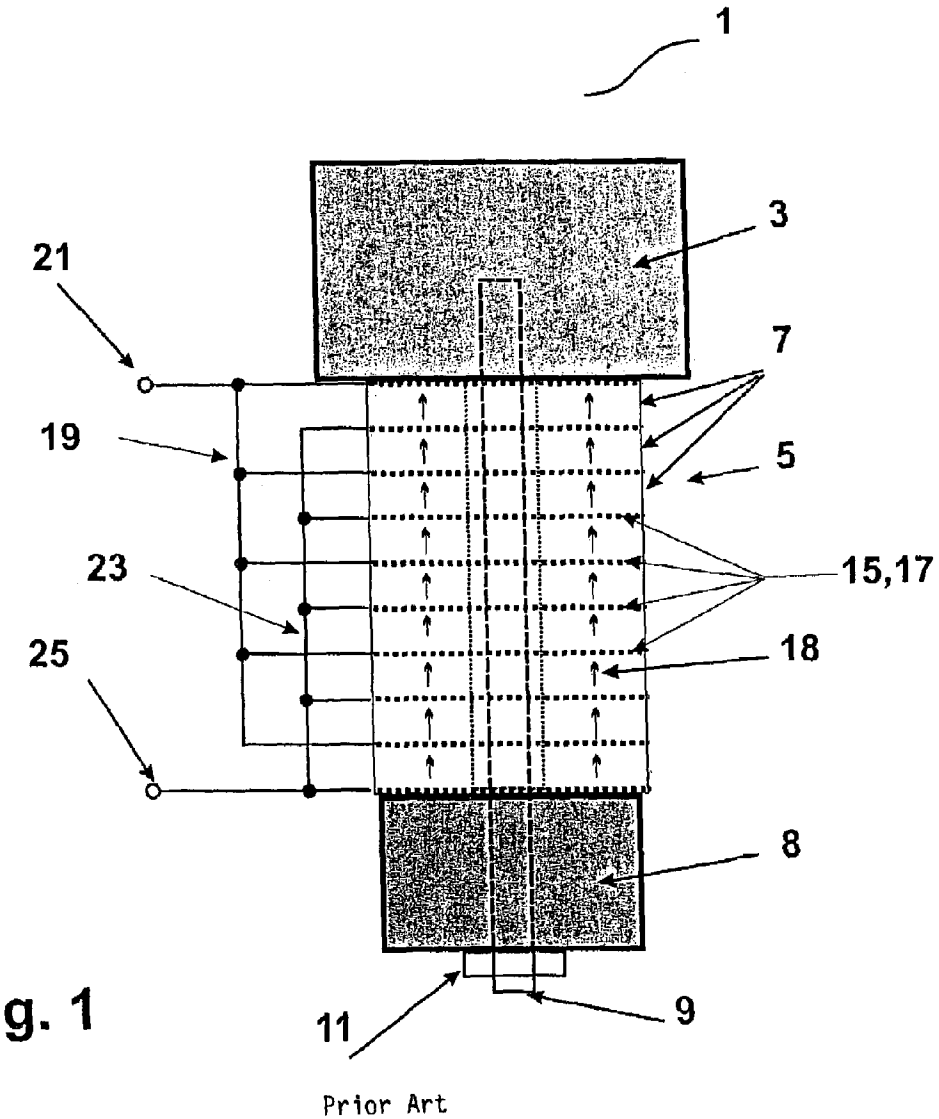
FIG. 1 is a schematic drawing of a conventional Tonpilz transducer.
Figure 2:
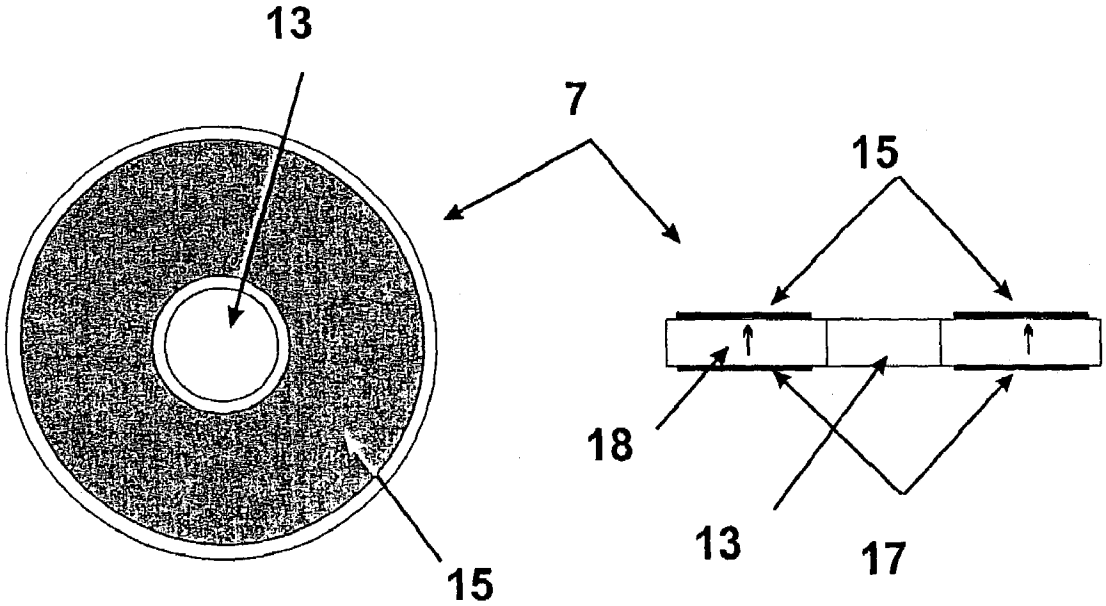
Fig. 2 Prior Art
FIG. 2 is a schematic drawing of an annular piezoelectric disk with electrodes in a conventional Tonpilz transducer.
Figure 3:
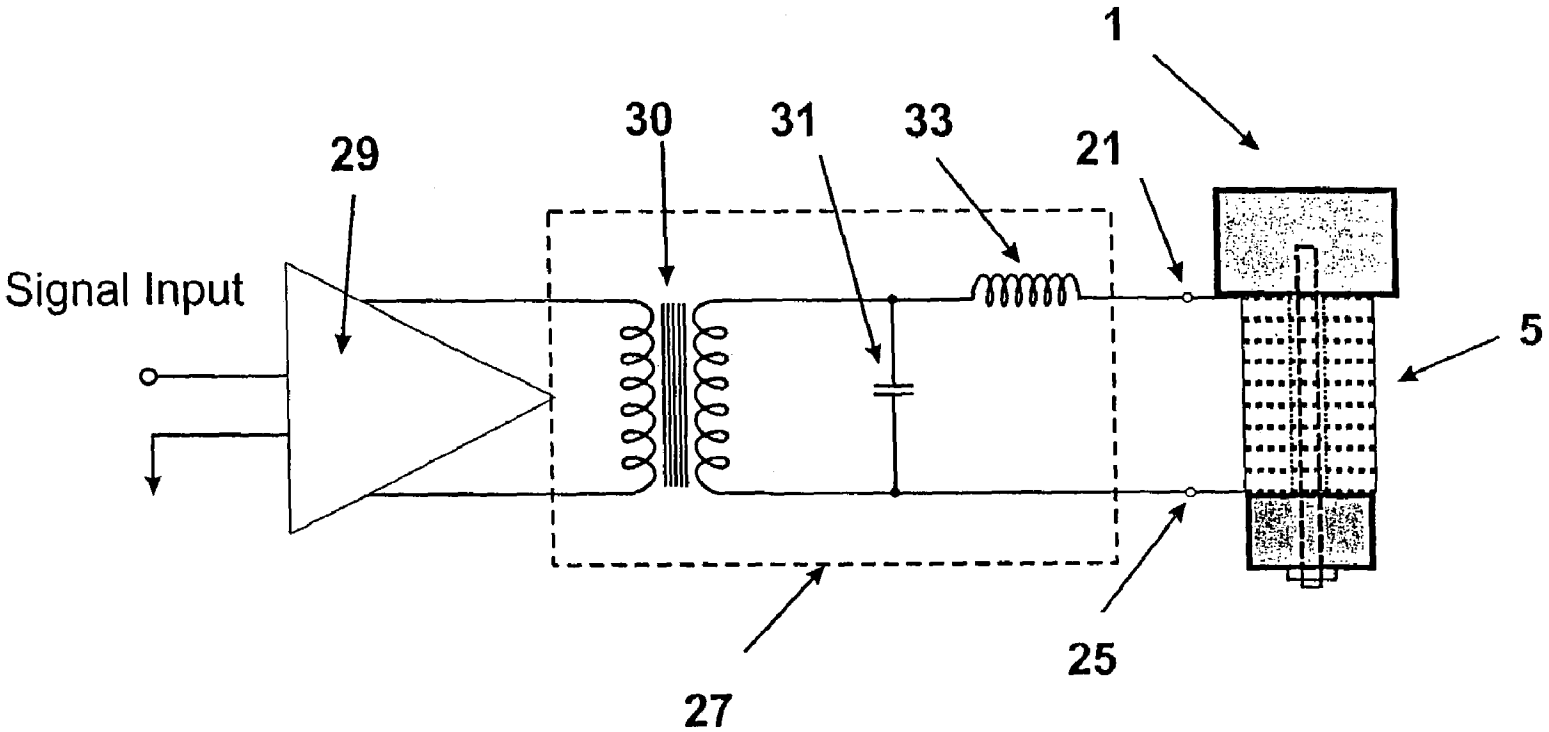
Fig. 3 Prior Art
FIG. 3 is a schematic drawing of a power amplifier, matching network connected to a conventional Tonpilz transducer.
Figure 4:
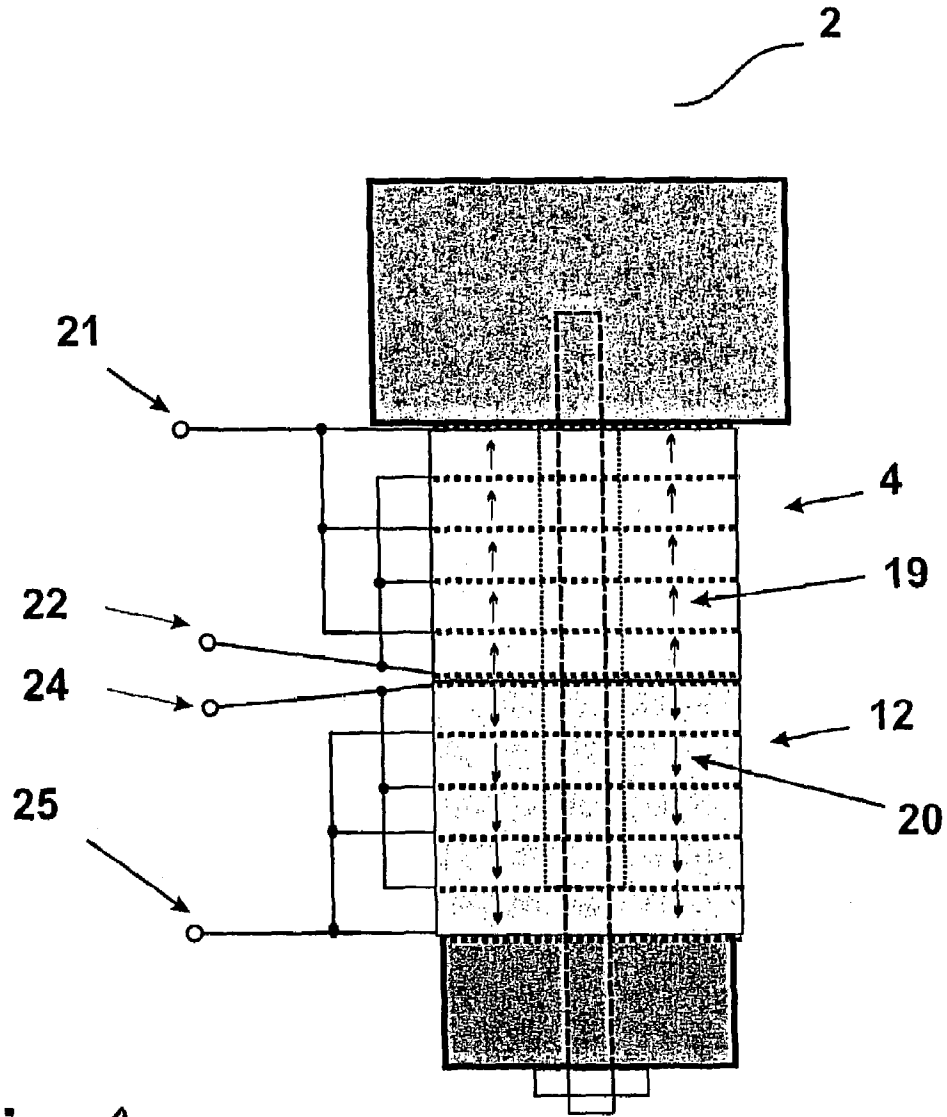
FIG. 4 is a schematic drawing of a preferred embodiment of the "push-pull" Tonpilz transducer of the present invention.

The "push-pull" Tonpilz transducer 2 of the invention is shown in FIG. 4. In place of the stack 5 of eight disks with similarly aligned polarizations as shown in FIG. 1, there are two separate stacks 4 and 12 with opposed polarizations 19 and 20, respectively. Interconnections within each stack are made as before, however, stack 4 has its own external connections 21 and 22; and stack 12 is connected at 24 and 25. These external connections are made to the push-pull amplifier at similar positions as shown.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. In a Tonpilz transducer comprising a first stack of piezoceramic elements with a first plurality of electrodes connected to form a first pair of external connections, wherein the improvement comprises a second stack of piezoceramic elements with a second plurality of electrodes connected to form a second pair of external connections, and said first and second stacks of piezoceramic elements have opposed polarizations, such that the opposing polarization make it possible to drive the transducer with a push-pull amplifier.

* * * * *